US008533891B2

(12) United States Patent
Waguespack

(10) Patent No.: US 8,533,891 B2
(45) Date of Patent: Sep. 17, 2013

(54) TOOTHBRUSH THAT PROVIDES ENHANCED CLEANING AND COMFORT

(75) Inventor: Kenneth Waguespack, North Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 1066 days.

(21) Appl. No.: 11/535,259

(22) Filed: Sep. 26, 2006

(65) Prior Publication Data

US 2007/0067933 A1 Mar. 29, 2007

Related U.S. Application Data

(60) Provisional application No. 60/720,418, filed on Sep. 26, 2005.

(51) Int. Cl.
*A46B 9/04* (2006.01)

(52) U.S. Cl.
USPC ..... 15/167.1

(58) Field of Classification Search
USPC ..... 15/167.1, 201, 207.2, 110, 191, 0.1, 15/183, 106, 172
See application file for complete search history.

(56) References Cited

U.S. PATENT DOCUMENTS

| | | | | |
|---|---|---|---|---|
| 2,164,219 | A | 6/1939 | McGerry | |
| 2,244,098 | A * | 6/1941 | Busick | 15/172 |
| 4,432,114 | A | 2/1984 | Goudsmit | |
| 4,471,505 | A | 9/1984 | Spademan | |
| 4,493,126 | A | 1/1985 | Uy | |
| 4,638,521 | A | 1/1987 | Potente et al. | |
| 4,762,373 | A | 8/1988 | Amos et al. | |
| 5,524,319 | A | 6/1996 | Avidor | |
| 5,799,354 | A * | 9/1998 | Amir | 15/167.1 |
| 5,836,033 | A | 11/1998 | Berge | |
| 5,956,797 | A * | 9/1999 | Wilson | 15/167.1 |
| 6,105,191 | A | 8/2000 | Chen et al. | |
| 6,571,417 | B1 | 6/2003 | Gavney, Jr. et al. | |

FOREIGN PATENT DOCUMENTS

| | | |
|---|---|---|
| DE | 93 19 232 U1 | 3/1994 |
| JP | 2002 010832 | 1/2002 |
| RU | 2241363 | 3/2004 |
| WO | WO 2004/014182 A | 2/2004 |

OTHER PUBLICATIONS

Decision on Grant from the Patent Office of the Russian Federation for corresponding Russian Patent Application No. 2008116608.

* cited by examiner

*Primary Examiner* — Robert Scruggs
(74) *Attorney, Agent, or Firm* — Ryan M. Flandro

(57) ABSTRACT

A toothbrush includes cleaning element support members that enhance cleaning and user comfort while brushing. The cleaning element support members permit a head of the toothbrush to be comfortably received and manipulated within the user's mouth. The toothbrush head includes a first flexible cleaning element support member positioned at a first end of the head, a second flexible cleaning element support member positioned at a second, free end and an intermediate flexible cleaning element support member. Each flexible cleaning element support member has a flexible stem formed of a resilient material.

25 Claims, 4 Drawing Sheets

TOOTHBRUSH THAT PROVIDES ENHANCED CLEANING AND COMFORT

CROSS REFERENCE TO RELATED APPLICATION

This application claims the benefit of priority to U.S. Application No. 60/720,418, filed Sep. 26, 2005, in which the contents are incorporated by reference.

FIELD OF THE INVENTION

The present invention relates to a manually manipulated toothbrush having a head with flexible sections that provide enhanced cleaning and comfort when used.

BACKGROUND OF THE INVENTION

Conventional toothbrushes usually include a substantially rigid head with an outer surface from which cleaning elements extend. Conventional cleaning elements include bristles arranged in bristle tufts, elastomeric members or other known cleaning elements. However, rigid portions of certain conventional toothbrush heads can prevent the cleaning elements from being comfortably received in the mouth, and thereby prevent effective cleaning of the oral cavity.

To eliminate the problems associated with large, rigid toothbrush heads, certain conventional toothbrush heads include flexible segments that allow carried cleaning elements to move relative to the head. However, these flexible segments may not fit comfortably within the mouth of the user. Similarly, because of the size and/or shape of the flexible segments, the heads may not be comfortably manipulated within the mouth of the user during cleaning. As a result, the toothbrush may not be used on a regular basis. Additionally, when introduced into the mouth, the toothbrush may not be used for a period of time sufficient to provide the person with effective oral cleaning. It is also possible that the cleaning elements may not be capable of reaching all intended portions of the mouth. This can result in poor oral hygiene that can cause tooth and/or gum disease.

SUMMARY OF THE INVENTION

The present invention pertains to a toothbrush with flexible cleaning element support members that provide the user with enhanced cleaning and comfort during brushing. The cleaning element support members permit a head of the toothbrush to be comfortably received and manipulated within the user's mouth.

In one aspect of the invention, the toothbrush includes a head with a first flexible cleaning element support member positioned at a first end of the head, a second flexible cleaning element support member positioned at a second, free end of the head and at least one intermediate flexible cleaning element support member. Each flexible cleaning element support member has a flexible stem formed of a soft, resilient material that is comfortable to the user when the material contacts a portion of the user's mouth. Additionally, the flexible cleaning element support members carry cleaning elements. The flexibility of these support members allows the cleaning elements to move easily in different directions during brushing, thereby providing enhanced cleaning.

In another aspect of the invention, the toothbrush has at least two flexible cleaning element support members that each forms a continuous outer surface with a respective end of the head so that the head can be comfortably received and manipulated in a mouth.

DETAILED DESCRIPTION OF THE INVENTION

Figure 1:
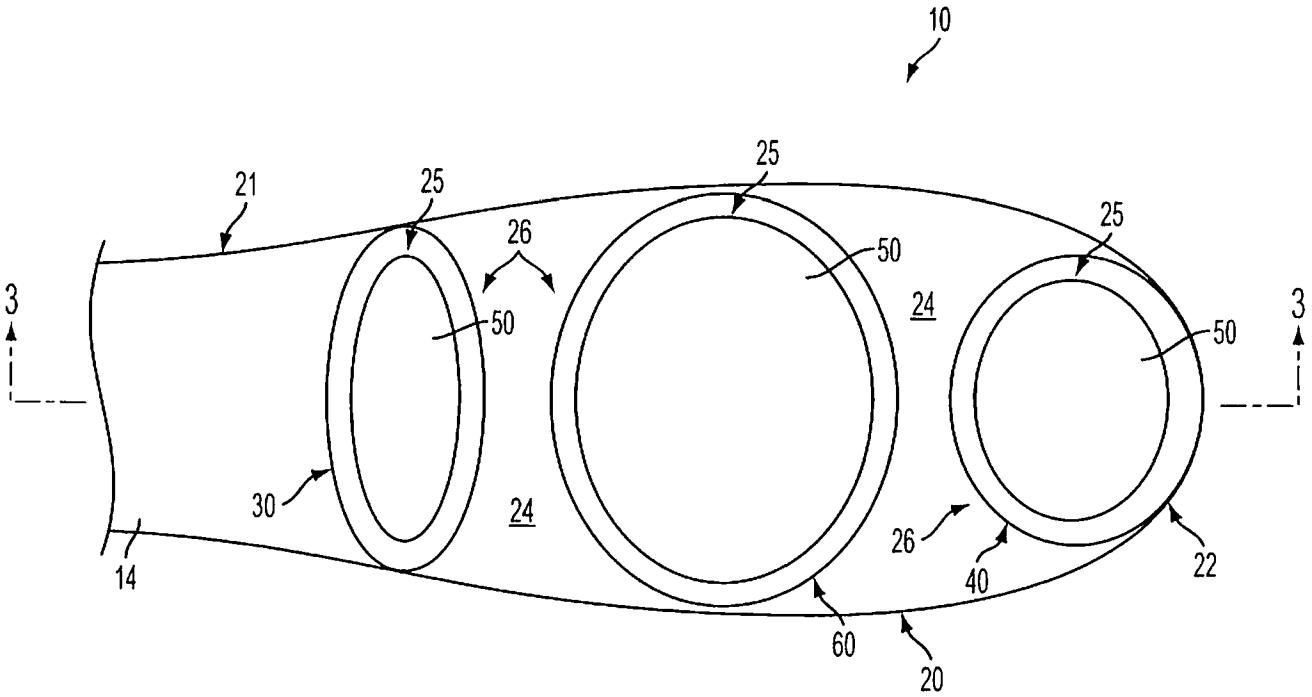
FIG. 1 is a top view of a portion of a toothbrush in accordance with an aspect of the present invention.

FIG. 1 illustrates a toothbrush 10 according to an aspect of the present invention. The toothbrush 10 includes an elongated handle (not shown) that may be formed of any shape and with a variety of constructions that permit the toothbrush 10 to be readily gripped and manipulated for effective tooth and gum cleaning. The toothbrush 10 also includes a neck 14 and a head 20 having a first end 21 proximate the neck 14 and a second, free end 22 distal the neck 14. The head 20 also includes a base 24 and spaced cleaning element support members 26. The base 24 provides an area onto which the cleaning element support members 26 are secured, in any known manner (See FIG. 2).

Figure 2:
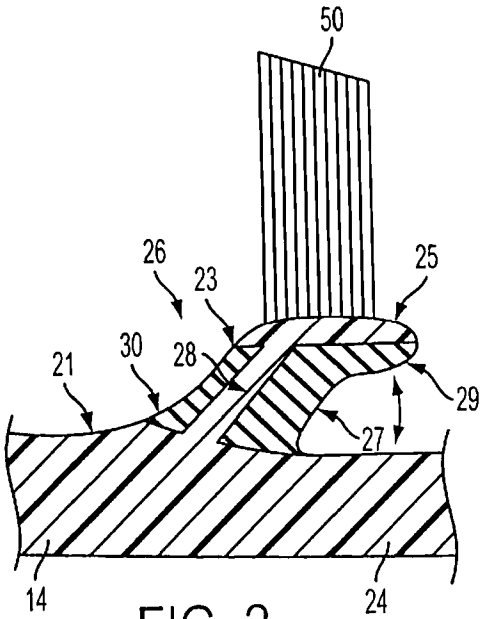
FIG. 2 is a cross section of an exemplary cleaning element support member according to an aspect of the present invention.

FIG. 2 illustrates an isolated example of a cleaning element support member 26 according to an aspect of the present invention. The exemplary cleaning element support member 26 includes a stem 27 and a flexion control member 28 positioned within the stem 27. The cleaning element support members 26 also include a support head 23 with a section 29 that overhangs the stem 27 in the direction of the center of the other cleaning element support members 26. The body of the stem 27 that surrounds each flexion control member 28 and each support head 23 are formed of flexible materials, such as flexible resins. In an embodiment, the flexible resins usable with the support members 26 include soft thermoplastic elastomers (TPE). Other soft, resilient materials can also be used to form the stems 27 and the support heads 23. The resilient material of the support members 26 serves to bias the stems 27 and flexion control members 28 back to initial, rest position after they have been deflected. This return action creates an active motion in the opposite direction of the initial flexion of the support members 27, which aids in the cleaning of teeth by introducing additional cleaning strokes and by strengthening the cleaning stroke because of the bias force created by the material.

The flexion control members 28 limit the flexibility of their respective support members 26. The internally extending flexion control members 28 can be of any shape that allows some flex and have a cross-section that is circular, square or any other geometric shape that provides a thin dimension or thin diameter about which the support member 26 can bend. The size of this thin dimension/diameter can contribute to the total amount of flex experienced by each cleaning element support member 26.

The flexion control members 28 are each secured to the base 24 or alternatively they are formed together with the base 24 as an integral unit. The flexion control members 28 can be formed of conventional hard plastic materials, such as polypropylene. In an alternative embodiment, the flexion control members 28 can be formed of a more flexible material that allows their respective stems 27 additional movement in a direction at an angle to its length during brushing. For example, each stem 27 would be capable of deflecting in a direction toward the center of the head 20 and, in embodiments, for example, with circular cross sections, deflect in all directions that extend at an angle to the longitudinal axis of the support member 26.

The cleaning element support members 26 also include carriers 25 that each supports at least one cleaning element 50. The cleaning elements can be used to clean the teeth, gums and/or tongue of a user. In the illustrated embodiment of FIG. 1, the cleaning elements 50 are in the form of bristles arranged in bristle tufts 52 that are secured to the carriers 25. However, one or more elastomeric members or other forms of cleaning members may be used to form the cleaning elements in lieu of or in addition to the use of bristles arranged in bristle tufts. The term "cleaning element" is intended to be used in a generic sense which could also include massage elements and other forms of cleaning elements such as elastomeric fingers or walls arranged in a circular cross-sectional shape or any type of desired shape and/or cross-section including straight portions or sinusoidal portions.

The carriers 25 are each supported by a flexion control member 28 and secured to the support head 23 of their respective stem 27, as illustrated in FIG. 2. The carriers 25 are preferably formed from conventional hard plastic materials, such as polypropylene, commonly used in the making of toothbrush handles and heads. However, other known hard materials can be also be used. The cleaning elements 50 extend from the carriers 25 for performing an oral care function within the mouth of the user. The tooth cleaning elements 50 can be anchored to their carrier 25 using any known technique. For example, the tooth cleaning elements 50 can be anchored into their carrier 25 during the formation of the carrier 25 (e.g., in mold tufting or anchor free tufting). Alternatively, the cleaning elements 50 can be anchored using other known techniques, such as, stapling, pinning or gluing.

While FIGS. 2-5 illustrate the cleaning elements 50 oriented generally perpendicular to the outer surface of base 24, some or all of the cleaning elements 50 may be oriented at various angles with respect to the outer surface of the base 24. It is thereby possible to select the combination of cleaning element configurations, materials and orientations to achieve specific intended results to deliver additional oral health benefits, like enhanced cleaning, tooth polishing, tooth whitening and/or massaging of the gums.

Figure 3:
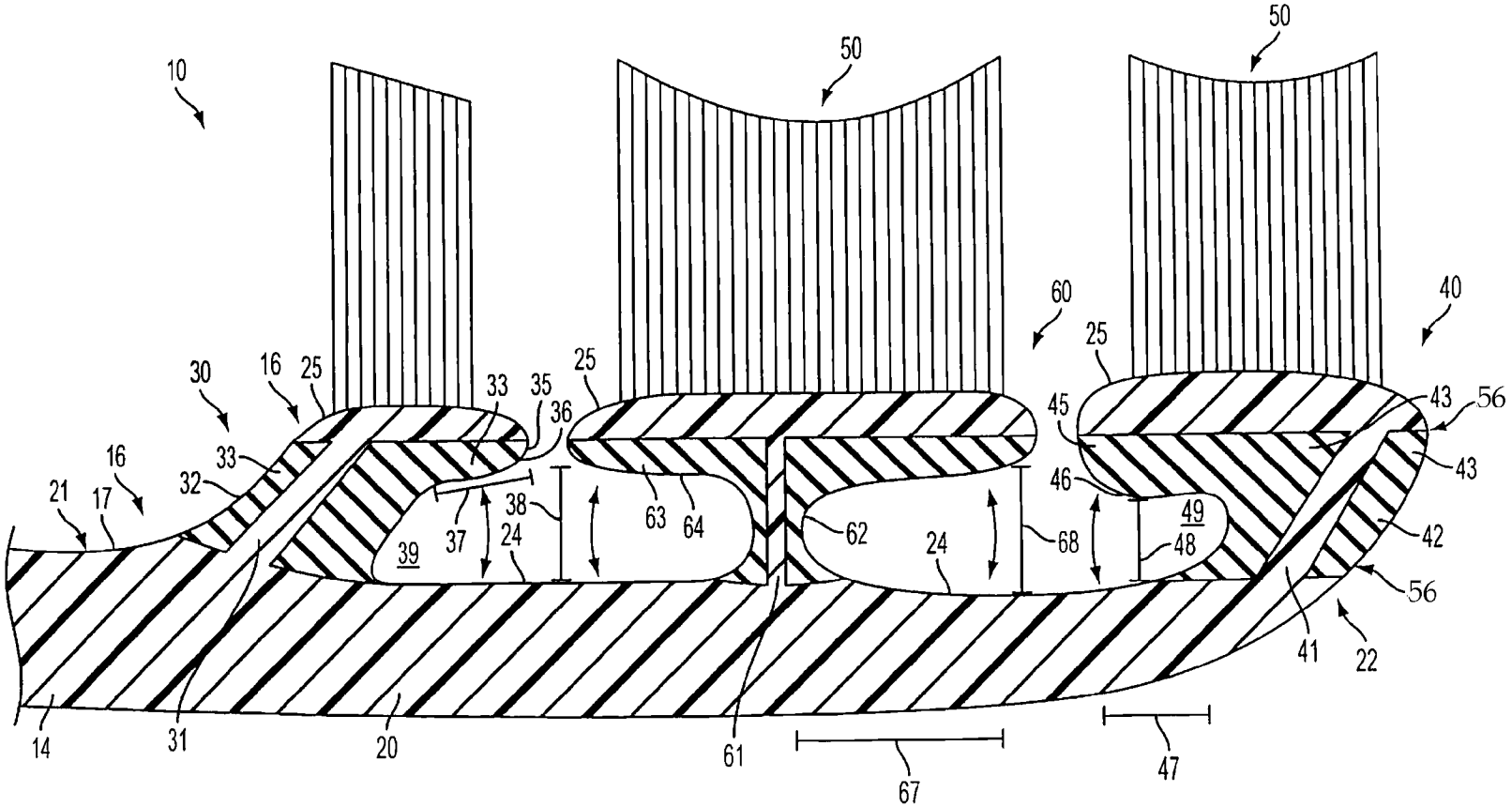
FIG. 3 is a cross section taken along line 3-3 of FIG. 1.
Figure 5:
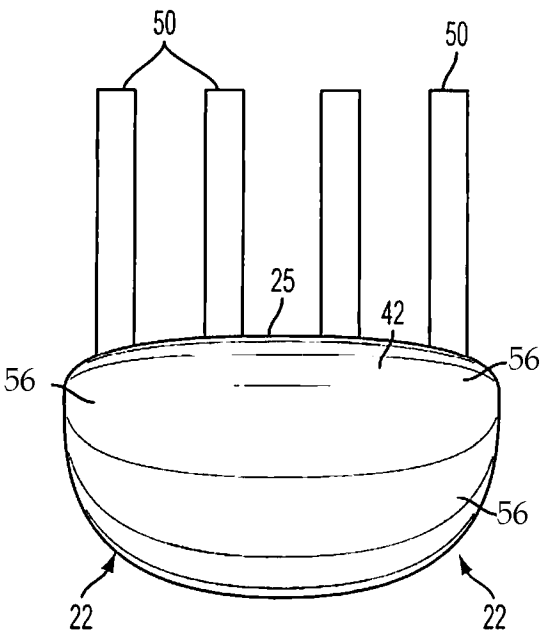
FIG. 5 is an elevational view of a portion of the toothbrush shown in FIG. 1 taken opposite the view of FIG. 4.
Figure 4:
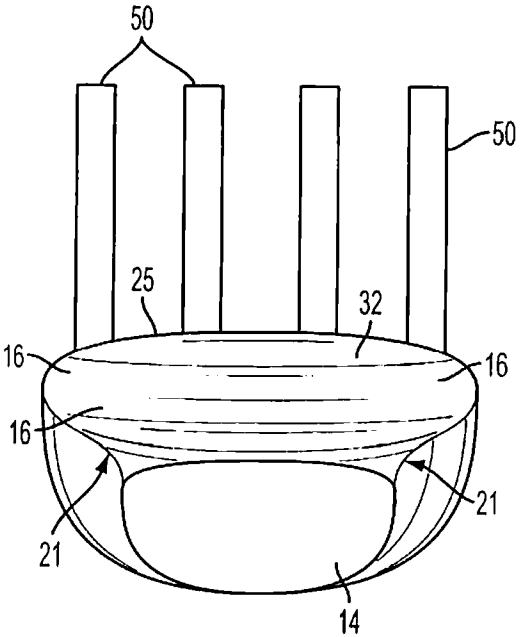
FIG. 4 is an end view of the portion of the toothbrush shown in FIG. 1.

As shown in FIGS. 1-3, the head 20 includes a plurality of the exemplary cleaning element support members 26. In the illustrated embodiment, the head 20 includes three spaced cleaning element support members 30, 40, 60 having the same components as support members 26. However, the head 20 can include only two or more than three support elements spaced along the head 20. The positioning of the support elements 26 along the head 20 is not limited to the linear arrangement illustrated in the figures. Instead, the support elements 26 can be arranged in any fashion on the head 20.

As illustrated in FIG. 3, the first support member 30 is positioned at the first end 21 of the head 20. The body of this support member 30 includes a stem 32 and a support head 33. The stem 32 forms a smooth, continuous surface 16 with a portion 17 of the head 20 proximate the neck 14. The continuous surface 16 formed between the head 20 and the stem 32 is sized and shaped so it will be easily received and manipulated within the mouth. The continuous surface 16 provides a profile having a shape that is similar to that of a comfortable, conventional toothbrush head. Additionally, the soft material used to form the stem 32 will deflect when it engages a portion of the user's mouth. As a result, the soft, flexible material of the stem 32 provides the user with additional comfort.

The support head 33 has a greater diameter/width than the stem 32 that extends away from it toward the neck 14. The portion 35 of the support head 33 that overhangs the stem 32 creates a partial mushroom-shaped profile. This portion 35 is also movable relative to the stem 32 and the base 24, as illustrated by the arrows in FIG. 3. The overhanging portion 35 has a lower surface 36 spaced from the base 24 by a distance 38. As shown, a channel 39 is formed between the lower surface 36 and the base 24. The distance 38 is greater than the distance 37 that the overhanging portion 35 extends beyond the stem 32 in the direction of the second end 22. The distance 38 allows the overhanging portion 35 to deflect toward the base 24.

The flexion control member 31 within the stem 32 limits the total deflection of the support member 30 and cooperates with the material of the stem to return the stem 32 and its carrier 25 to their original, rest position. This deflection and return movement of the stem 32 and its carrier 25 allow the cleaning elements 50 to follow the teeth during cleaning and create an enhanced cleaning action within the mouth of the user. In an alternative embodiment, the distance 38 could be shorter than the distance 37. In such an embodiment, the base 24 could limit the travel of the overhanging portion 35. Regardless of the distance 38, the support member 30 is capable of achieving 360 degrees of movement relative to its central longitudinal axis.

The second end 22 of the head 20 also includes the second cleaning element support member 40 that forms a continuous smooth surface 56 with the free end of the base 24 at the second end 22 of the toothbrush 10. The continuous surface 56 is sized and shaped so it will be easily received and manipulated within the mouth of the user. As shown, the second end 22 has a convexly curved profile that is similar to some comfortable, conventional toothbrush heads. This convex curve allows the end of the toothbrush 10 to be easily and comfortably received within the user's mouth during brushing. Additionally, the soft material used to form the stem 42 will deflect when it engages a portion of the user's mouth. As a result, the soft, flexible material of the stem 42 provides the user with additional comfort.

The body of this support member 40 includes the stem 42 that carries a support head 43 and a flexion control member 41. The support head 43 has a greater diameter/width than the stem 42 and forms a partial mushroom-like shape, as illustrated. The portion 45 of the support head 43 that overhangs the stem 42 is similar to overhanging portion 35. The overhanging portion 45 is movable relative to the base 24 and includes a lower surface 46 that is spaced from the base 24 by a distance 48. As shown, a channel 49 is formed between the lower surface 46 and the base 24. The distance 48 is less than a distance 47 that the overhanging portion 45 extends beyond the stem 42 in the direction of the first end 21. Alternatively, the distance 48 could be greater than the distance 47, as discussed above with respect to support member 30. The distance 48 allows the overhanging portion 45 to deflect toward the base 24 and provide the same cleaning benefits discussed above with respect to the first support element 30. Additionally, the support member 40 is capable of achieving 360 degrees of movement relative to it central longitudinal axis.

As shown in FIG. 3, the head 14 also includes at least one intermediate support member 60 positioned between the support members 30, 40. The total number of intermediate support members 60 can vary based on their size, the size of the base 24 and the distance between the support members 30, 40. As with the other support members 30, 40, the intermediate support member 60 includes a flexion control member 61, a flexible stem 62, and a flexible support head 63 that receives a carrier 25.

As shown in FIG. 3, the support member 60 has a substantially mushroom-like shape. A lower surface 64 of the support head 63 is spaced from the base 24 by a distance 68 that is less than its length 67 from the stem 62. Nevertheless, the distance 68 is sufficient to permit the flexible support head 63 to deflect in any direction toward the base 24. In an alternative embodiment, the length 67 can be less than the distance 68 so that the base 24 cooperates to control the total deflection of the stem 62. Due to its shape and materials, the intermediate support member 60 can deflect in any direction. The support head 63 is capable of flexing in the direction of the first end 21, the second end 22 and/or the sidewalls of the head 20. As a result, the resilient intermediate support member 60 is capable of moving in all directions to provide enhanced cleaning to the teeth of the user.

While only a few toothbrush variations are disclosed herein, the invention could be used in toothbrushes having many variations in, for example, the head, handle, and materials used. Additionally, the toothbrush could be a powered toothbrush. The head 20 can also be removably secured to the handle 12 whether it is powered or manual. Further, those skilled in the art will appreciate that there are numerous variations and permutations of the above described systems and techniques. It is to be understood that other embodiments may be utilized and structural and functional modifications may be made without departing from the scope of the present invention.

What is claimed is:

1. A toothbrush comprising:

a head comprising a base and a longitudinal axis;

a first flexible cleaning element support member extending from said base and comprising a first flexible stem and a first flexible support head having a portion overhanging a portion of said first flexible stem, said first flexible stern located on the longitudinal axis;

a second cleaning element support member spaced from said first cleaning element support member along said base and comprising a second flexible stem and a second flexible support head having an outer peripheral edge, said second flexible stern located on the longitudinal axis;

a first portion of said outer peripheral edge of said second flexible support head overhangs a portion of said second flexible stem and a second portion of said outer peripheral edge of said second flexible support head is free of an overhang relative to said second flexible stem such that the second portion of said outer peripheral edge of said second flexible support head and said second flexible stem collectively form a continuous smooth surface with an outer surface of the base at a free end of the head;

wherein said second flexible support head is spaced a first distance from said base, said first distance forming a first gap between an undersurface of said second flexible support head and said base;

wherein the overhanging portion of the first flexible support head is spaced by a second distance from the overhanging portion of the second flexible support head, said second distance forming a second gap between the overhanging portions of the first and second flexible support heads; and tooth cleaning elements extending from a top surface of said second flexible support head, wherein said tooth cleaning elements are positioned on said second flexible support head so that an axis that is substantially normal to said longitudinal axis of said head intersects said first gap and a point on said top surface where at least one of said tooth cleaning elements connect to the second flexible support head.

2. The toothbrush of claim 1, wherein each cleaning element support member further comprises a flexion control member.

3. The toothbrush of claim 2, wherein said flexible stems further comprise flexion control members.

4. The toothbrush of claim 2 said flexion control members are capable of flexing relative to said base, and wherein each flexible stem is formed of a resilient material.

5. The toothbrush of claim of claim 1, wherein said first portion of said outer peripheral edge of said second flexible support head overhangs a distance, and wherein said distance that said second flexible support head is spaced from said base is less than said distance that said second flexible support head overhangs.

6. The toothbrush of claim 1, further comprising a neck and a handle, and wherein said base, said first flexible stem and a portion of said first flexible support head form a continuous surface along a portion of said toothbrush proximate said neck.

7. The toothbrush of claim 1, wherein said flexible stems are formed of a resilient material.

8. The toothbrush of claim 1, further comprising a third flexible cleaning element support member positioned between said first and second flexible cleaning element support members.

9. The toothbrush of claim 8, wherein said third cleaning element support member comprises a third flexible stem, a third flexion control member positioned within said third flexible stem and a third flexible support head.

10. The toothbrush of claim 9, wherein said third cleaning, element support member further comprises a portion overhanging a portion of said third flexible stem on opposite sides of said third flexible stem.

11. The toothbrush of claim 1 wherein the overhanging portion of the first flexible support head extends from the first flexible stem along the longitudinal axis towards a proximal end of the head.

12. The toothbrush of claim 11 wherein the overhanging portion of the first flexible support head extends from the first flexible stem in a cantilevered manner toward the proximal end of the head, the overhanging portion of the first flexible support head terminating in a free end.

13. The toothbrush of claim 1 wherein the overhanging portion of the first flexible support head extends longitudinally along the head from the first flexible stem in a first direction and the second flexible support head extends longitudinally along, the head from the second flexible stem in a second direction that is opposite the first direction.

14. The toothbrush of claim 1 wherein said second gap extends uninterrupted from a location in between said overhanging portions of said first and second flexible support heads to said base.

15. A toothbrush comprising:

a handle, a head having a longitudinal axis, and spaced flexible cleaning element support members extending from a base of said head;

a first of said cleaning element support members being positioned proximate a first end of said head and comprising a first flexible stem and a first support head, the first support head having an outer peripheral edge having a first portion that overhangs said first flexible stem and a second portion that is free of an overhang relative to said first flexible stem;

the second portion of the outer peripheral edge of the first support head, the first flexible stern and an outer surface of the base forming a first continuous surface at said first end of said head, said first flexible stem located on the longitudinal axis;

a second of said cleaning element support members positioned proximate a second end of said head and comprising a second flexible stern having a first portion that overhangs said second flexible stem, said second flexible stem located on the longitudinal axis;

wherein each said first portion is spaced a distance from said base, said distance forming a gap between each said first portion and said base; and tooth cleaning elements extending from a top surface of said first support head, wherein said tooth cleaning elements are positioned on said first support head so that an axis that is substantially normal to said longitudinal axis of said head intersects said gap and a point on said top surface where at least one of said tooth cleaning elements connect to the first support head.

16. The toothbrush of claim 15, wherein said first continuous surface has a substantially concave profile.

17. The toothbrush of claim 15 wherein said first end of said head is opposite said second end.

18. The toothbrush of claim 15, wherein said second cleaning element support member includes a second support head, and wherein said first and second support heads are spaced from each other along the length of said base.

19. The toothbrush of claim 15, wherein each cleaning element support member further comprises an elongated flexion control member.

20. The toothbrush of claim 19, wherein each flexion control member is positioned in a respective one of said flexible stems.

21. The toothbrush of claim 20, wherein said flexion control members are capable of flexing relative to said base, and wherein each flexible stem is formed of a resilient material.

22. The toothbrush of claim 15, further comprising a third cleaning element support member positioned between said first and second cleaning element support members.

23. The toothbrush of claim 22 wherein said third cleaning; element support member comprises a third flexible stem, a flexion control member positioned within said third flexible stem and a flexible support head.

24. The toothbrush of claim 22, wherein said third cleaning element support member further comprises a portion overhanging a portion of said third flexible stem on opposite sides of said third flexible stem.

25. A toothbrush comprising:

a head extending along a longitudinal axis from a first end proximate a neck to a second free end distal the neck, the head comprising a base;

a cleaning element support member comprising a stem extending from the base and a support head, the stem comprising a first portion and a second portion, the support head having an outer peripheral edge comprising a first portion that overhangs the second portion of the stem and a second portion that is free of an overhang relative to the first portion of the stem;

the first portion of the stem, the second portion of the outer peripheral edge of the support head, and a portion of an outer surface of the base forming a continuous surface at the second free end of the head;

a gap formed between an undersurface of the support head and the base, the support head having an overhanging portion capable of deflecting into the gap in the direction of said base;

tooth cleaning elements extending from the support head of the cleaning element support member;

the support head having a greater width than the stem;

the continuous surface at the second free end of the head comprising a convex curve;

the overhanging portion of the support head extending from the stem in a cantilevered manner toward the first end of the head;

the overhanging portion extending a first distance from the stem and the undersurface of the support head separated from the base by a second distance is the gap, the first distance being greater than the second distance;

the tooth cleaning elements positioned on the support head so that: (1) a first axis that is substantially normal to said longitudinal axis of said head intersects said gap and a point on a top surface of the support head from which at least one of said tooth cleaning elements extends; and (2) a second axis that is substantially normal to said longitudinal axis of said head intersects said stem and a point on the top surface of the support head from which at least one of said tooth cleaning elements extends; and the stem located on the longitudinal axis.

* * * * *